US006550688B1

(12) United States Patent
Uglietto

(10) Patent No.: US 6,550,688 B1
(45) Date of Patent: Apr. 22, 2003

(54) RADIATOR WITH COVER AND MOUNTING BOARD AND METHOD OF INSTALLATION

(75) Inventor: Salvatore R. Uglietto, Winchester, MA (US)

(73) Assignee: Smiths Environmental Products Ltd., Chelmsford (GB)

( * ) Notice: Subject to any disclaimer, the term of this patent is extended or adjusted under 35 U.S.C. 154(b) by 0 days.

(21) Appl. No.: 09/584,299

(22) Filed: May 31, 2000

(51) Int. Cl.[7] ..... F24D 19/06
(52) U.S. Cl. ..... 237/79; 454/287; 454/246
(58) Field of Search ..... 237/79; 454/246, 454/287; 219/520

(56) References Cited

U.S. PATENT DOCUMENTS 2,355,629 A * 8/1944 Carrier ..... 219/363
3,464,177 A * 9/1969 Amato ..... 165/55
3,627,984 A * 12/1971 Bollinger ..... 219/365
3,780,797 A * 12/1973 Gebelius ..... 165/55
3,827,202 A * 8/1974 Phillips ..... 52/220
4,273,990 A * 6/1981 Steiner et al. ..... 219/363
4,471,991 A * 9/1984 Matthias ..... 296/91
4,689,470 A 8/1987 Cunningham ..... 219/213
4,714,194 A * 12/1987 Eckman ..... 237/70
5,406,937 A * 4/1995 Uglietto et al. ..... 126/640
5,597,033 A 1/1997 Caili ..... 165/55
5,651,224 A * 7/1997 Brabant ..... 52/288.1
5,950,720 A * 9/1999 Klix ..... 165/179

OTHER PUBLICATIONS

John Siegenthaler, Hydronic Baseboard Basics, The Journal of Light Construction Online.

* cited by examiner

*Primary Examiner*—Derek Boles
(74) *Attorney, Agent, or Firm*—Choate, Hall & Stewart

(57) ABSTRACT

A baseboard radiator having notched fins, a mounting strip, a mounting clamp, and a cover is described. The resulting system offers ease of leveling and installation, secure mounting, reduced noise and wear, and is aesthetically pleasing.

2 Claims, 10 Drawing Sheets

RADIATOR WITH COVER AND MOUNTING BOARD AND METHOD OF INSTALLATION

BACKGROUND

Baseboard radiators, such as described in U.S. Pat. No. 5,406,937 are mounted on a wall.

U.S. Pat. No. 5,597,033, incorporated herein by reference, notes the desire for easier installation of baseboard heaters, and the desire for attractive coordinating covers. CLAIMS U.S. Pat. No. 4,689,470 notes that present baseboard heaters are relatively complicated to install.

Baseboard heaters can be heavy and bulky. Flow of fluid in the pipes can be affected by improper leveling or the radiator during installation, and the radiator must be mounted above Floor level for proper air circulation.

Among the considerations for installation are is the need for an air space. For example, an article on Hydronic Baseboard Basics by John Siegenthaler, P. E. states, "When baseboard is installed before finish flooring, remember to leave at least a 1 inch space beneath the enclosure. This ensures that the finished floor will not block air coming into the enclosure." Also to prevent noise, it suggests using hangers that flex as the pipe expands and which are coated for handing copper tubing.

SUMMARY OF THE INVENTION

A first objective of the present invention is to provide ease of leveling and installation.

A second objective of the present invention is to provide extra securement of a baseboard radiator to the wall.

A third objective is to provide a readily attachable, attractive radiator cover for a baseboard heater.

A fourth objective is to accommodate expansion and contraction of the heating elements to reduce noise and wear on the system.

Disclosed herein are a mounting strip, a mounting clamp, a baseboard radiator having notched fins and an easily installed attractive cover.

DETAILED DESCRIPTION OF THE INVENTION

Figure 1A:
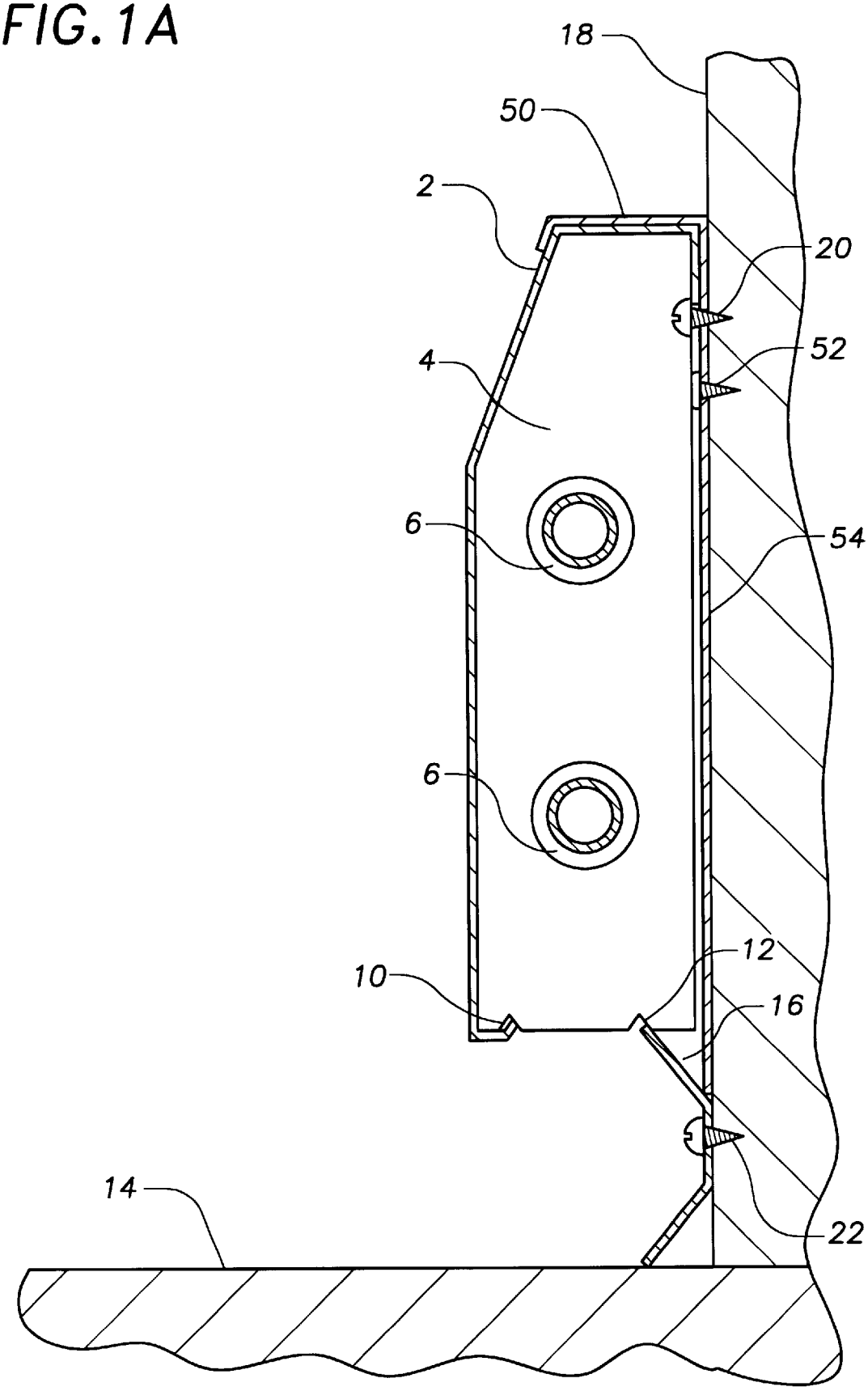
FIG. 1A is a cross sectional view of a first embodiment of the invention.

For ease of mounting, the fins 4 of a radiator having one or more pipes passing through apertures 6 have been provided with a rear notch 12 on the lower edge. For ease of attaching a cover 2, a front notch 10 has been provided on lower edge.

To mount the radiator 4 of the invention, a mounting board 16 is first leveled on the wall 18 near the floor 14. The mounting board 16 may rest on the floor 14 or be mounted slightly higher to leave room for a carpet. When leveled, the mounting board 16, is attached to the wall 18 with screws 22. With the mounting board 16 in place, mounting clamps 50 are secured to the wall 18 at intervals of about 40 inches, by one or more screws 52 through an elongated slot 54. The slot 54 allows the mounting clamp 50 to be raised during placement of the radiator and lowered to secure the radiator. When lowered, the lower edge 66 of the mounting clamp 50 rests on the top of the back plate 28 of the mounting board 16. With the mounting board 16, and mounting clamps 50 in a raised position, the fins 4 of the radiator are placed against the wall 18 so that the rear notches 12 rest on the top edge of the mounting board 16. If no cover 2 is to be added, the mounting clamps 50 are lowered, securing the fins 4 of the radiator in place. The radiator is the secured to the wall by screws 20 as described in U.S. Pat. No. 5,406,937. If a cover 2 is to be installed, the rear notch 12 in the lower edge of the fin and/or the size of the mounting strip flange is chosen to that a space 80 is maintained between the wall and the rear flange of the radiator fin 4, so that the radiator is mounted with a gap 80 between the wall 18 and the radiator. The cover 2 is placed over the fins 4 with the mounting clamps 50 raised, and the back flange 32 between the wall 18 and the radiator fins 4. Then the securing edge 41 or edges 40, 42 are snapped into the notch 10 on the lower front edge of the radiator fins 4. The mounting clamps 50 are then lowered, and the radiator is secured to the wall 18 by screws 20. This method of installation means that the radiator does not have to be held up during installation, more firmly secures the radiator to the wall and insures that the radiator remains level during installation. By properly choosing the materials and design of the mounting strip 16, the fins 4 of the radiator can slide to accommodate expansion during heating and contraction during cooling, since the point of contact is small. In a preferred embodiment, the mounting strip 16 is first formed from a strip of aluminium, which is light weight, and rapidly conducts heat. The top flange 24 and optionally the base flange 26 each make an angle of about 45° with the back plate 30. This provides that force vectors are evenly distributed against the wall 18 and the floor 14. A hole 28 is used for holding the mounting strip 16 during electrostatic powder coating. Such a coating provides an attractive, slick, heat and corrosion resistant finish. Suggested dimensions for the finished mounting strip 16 are: thickness 1 mm; depth of top flange 24 about 0.5 inches; depth of bottom flange 26 about 0.5 inches; height of back plate 30 about 1 inch; and the overall height about 2.75 inches.

FIGS. 3A to 3E show a variety of radiator covers for use with the invention. They are provided with securing edges 40, 41, 42 to engage the front notch 10 on the lower edge of the flange.

Figure 3A:
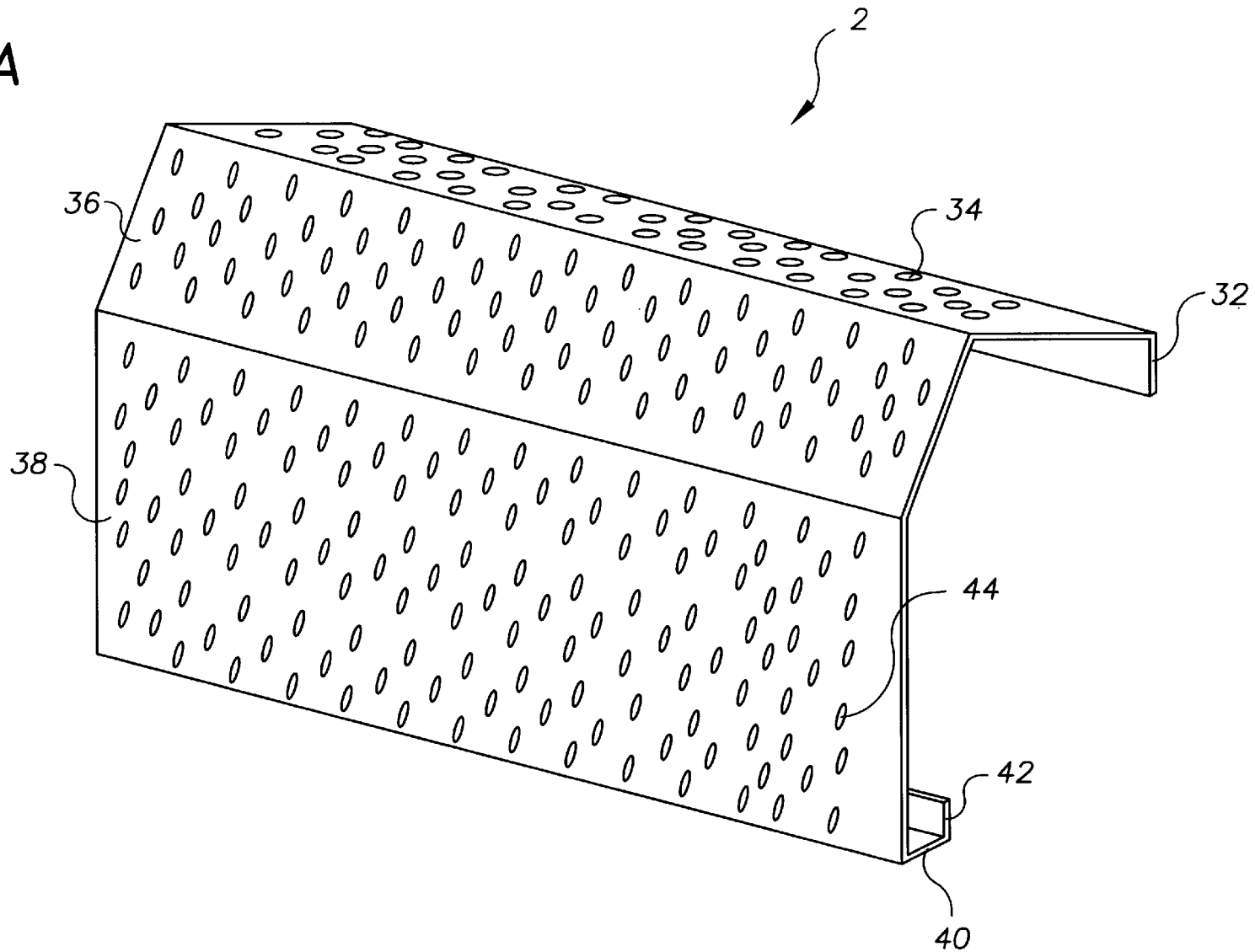
FIG. 3A is an isometric view of a first embodiment of the radiator cover.

The cover 2 shown in FIG. 3A has a back flange 32 that is placed between the radiator fins 4 and the wall 18, a top surface 34, an upper front surface 36, front surface 38, and lower securing edges 40 and 42 for engaging the front notch 10 shown in FIG. 1A. The exposed surfaces are provided with a series of apertures 44 to allow for free air circulation.

Figure 1B:
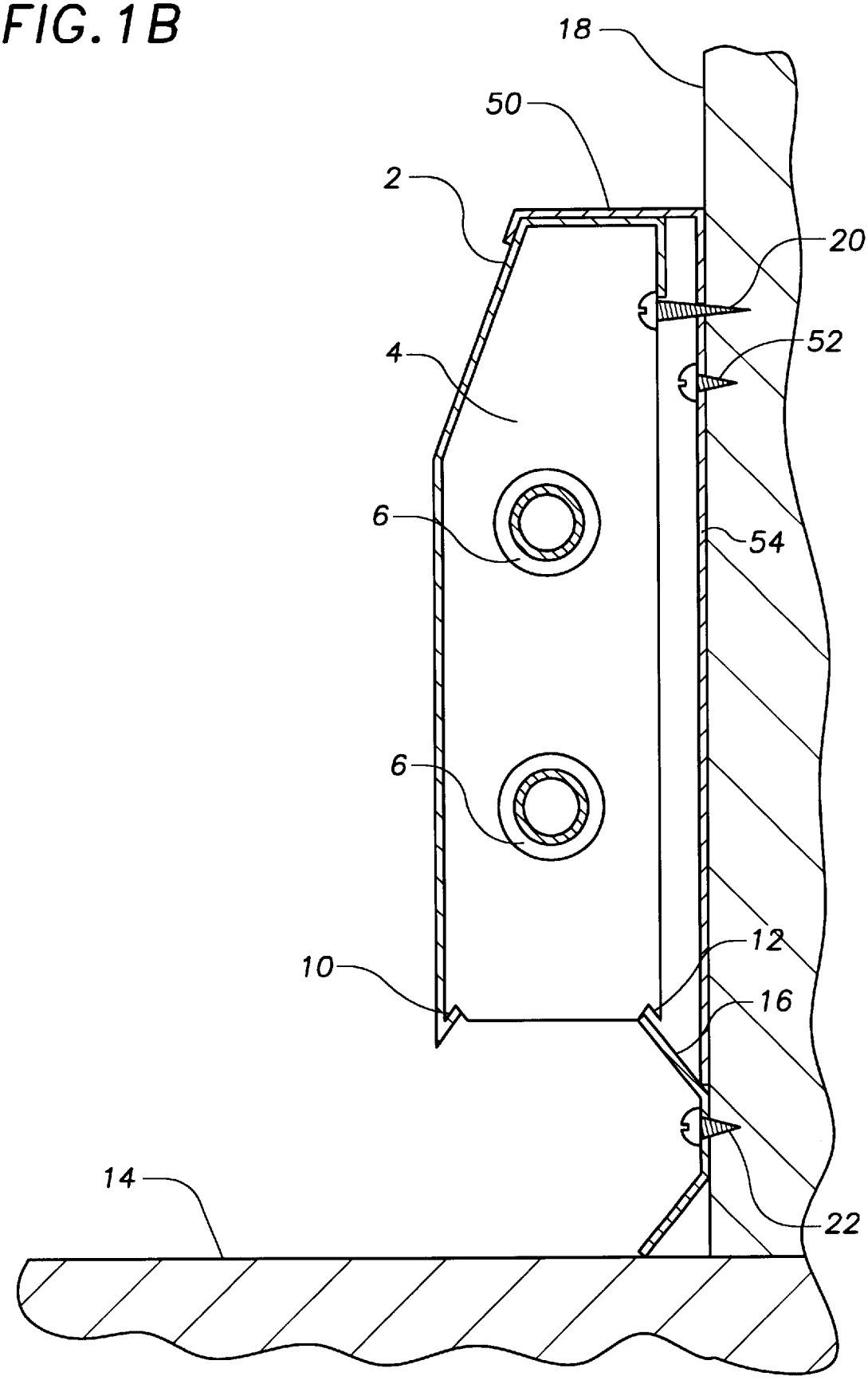
FIG. 1B is a cross sectional view of a second embodiment of the invention.
Figure 2:
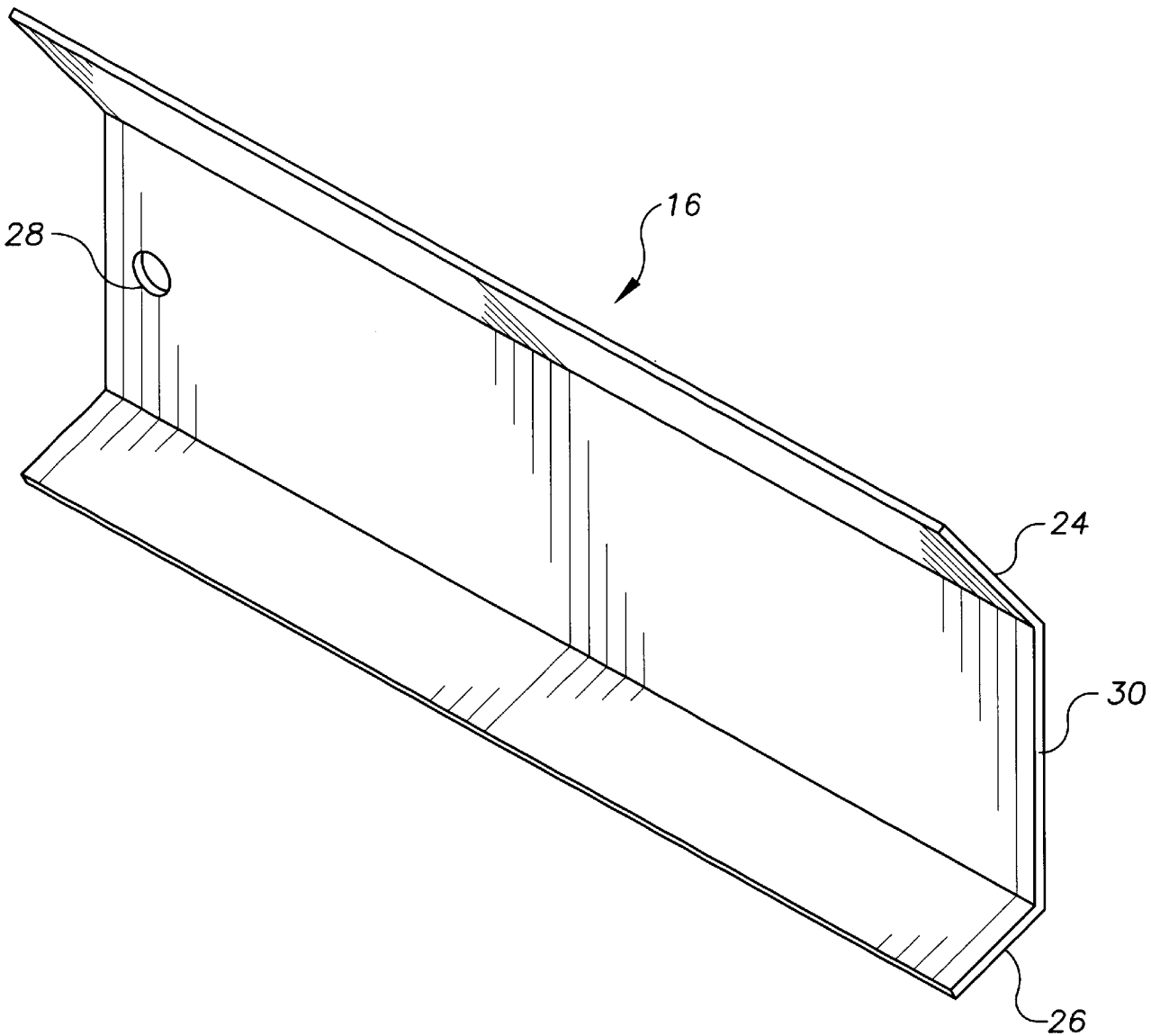
FIG. 2 is an isometric view of the mounting board.
Figure 3B:
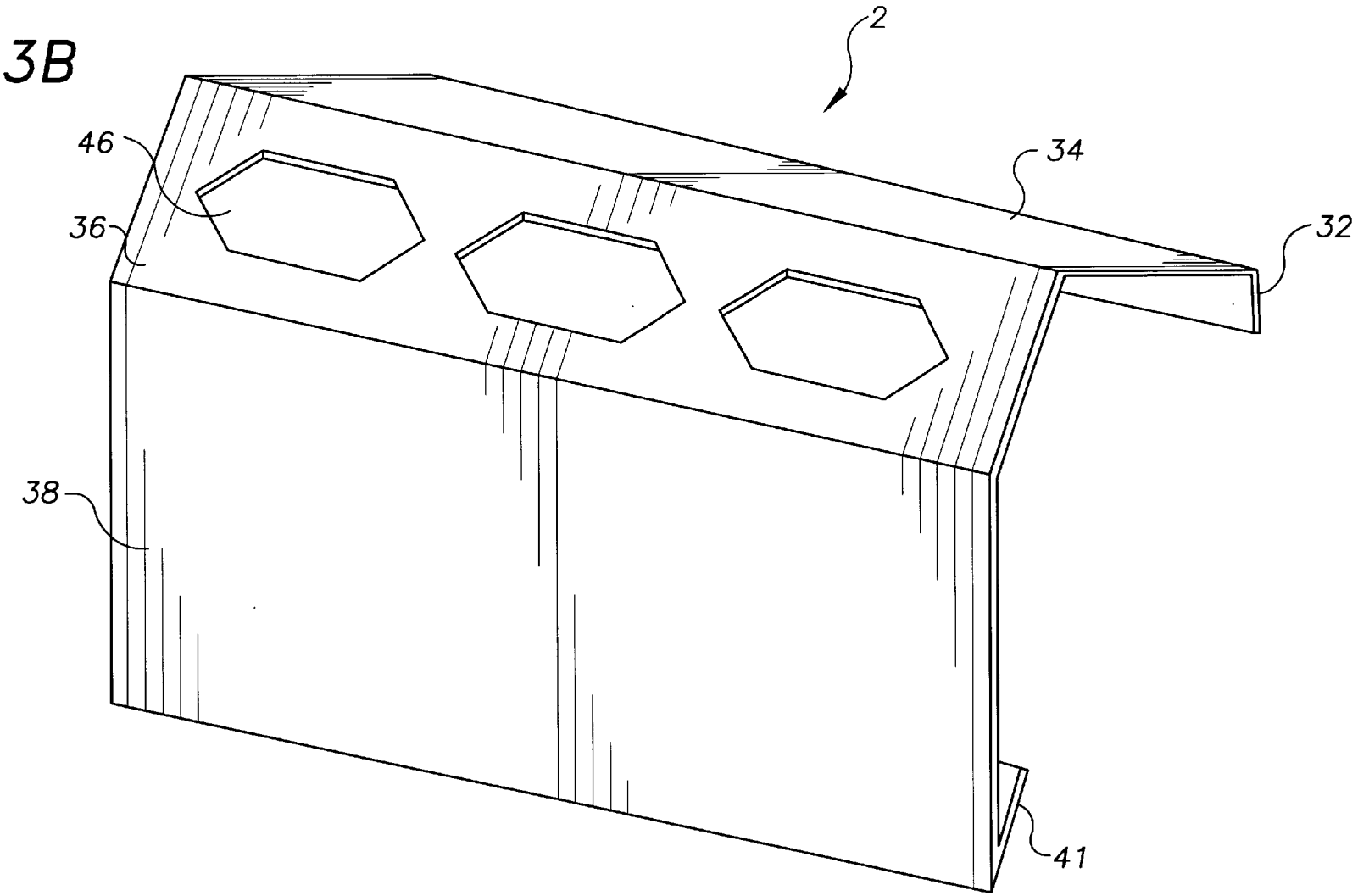
FIG. 3B is an isometric view of a second embodiment of the radiator cover.

The cover shown in FIG. 3B has a lower securing edge 41 for engaging the front notch 10 shown in FIG. 1B. The large elongated apertures 46 are close together, and allow for the cover the be attached to the radiator prior to the securing of the radiator fins 4 to the wall 18

Figure 3C:
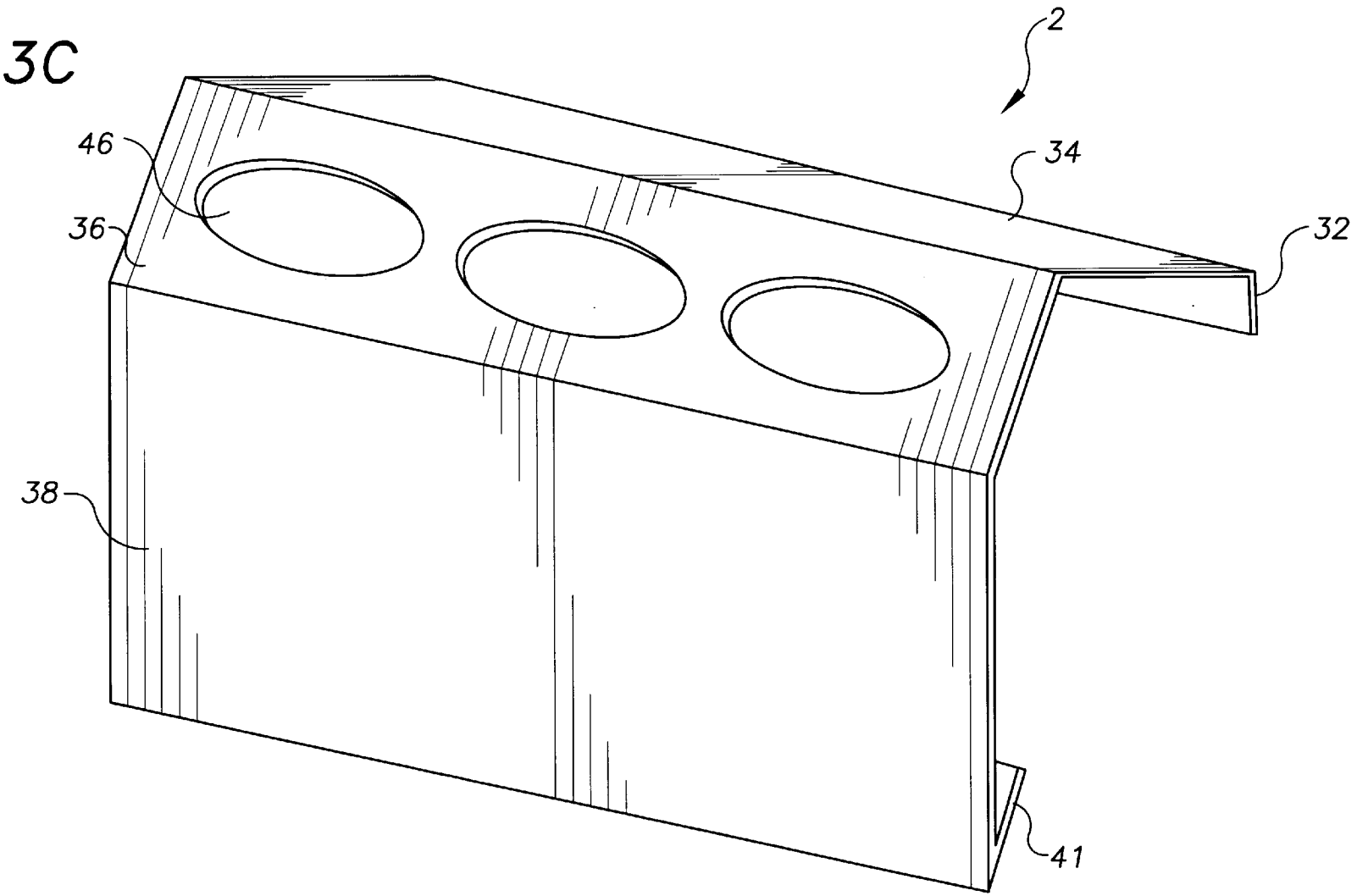
FIG. 3C is an isometric view of a third embodiment of the radiator cover.

The cover shown in FIG. 3C is similar to that shown in FIG. 3B, however the apertures 48 are oval.

Figure 3D:
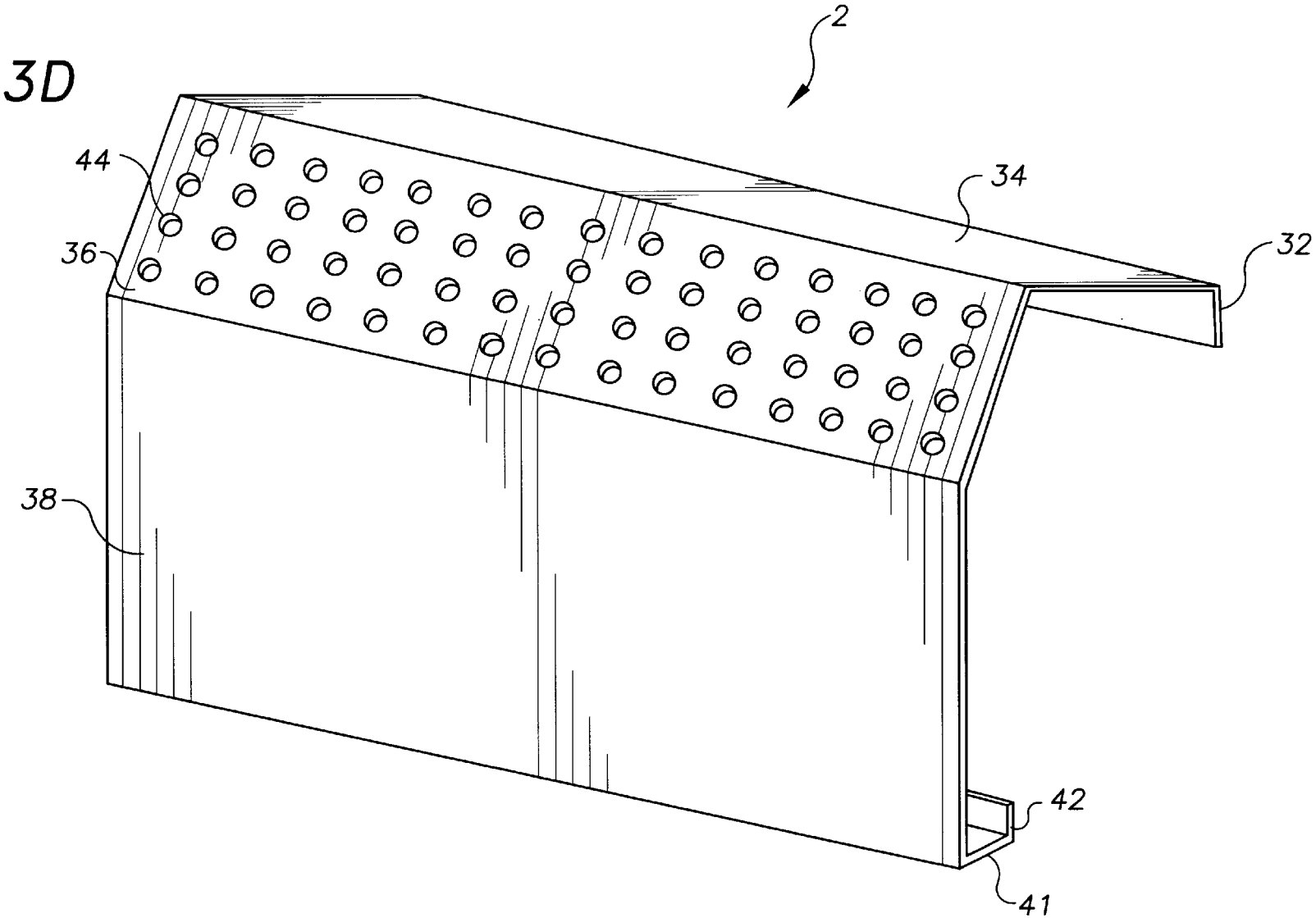
FIG. 3D is an isometric view of a fourth embodiment of the radiator cover.

The cover shown in FIG. 3D has small multiple apertures in the upper front surface 36.

Figure 3E:
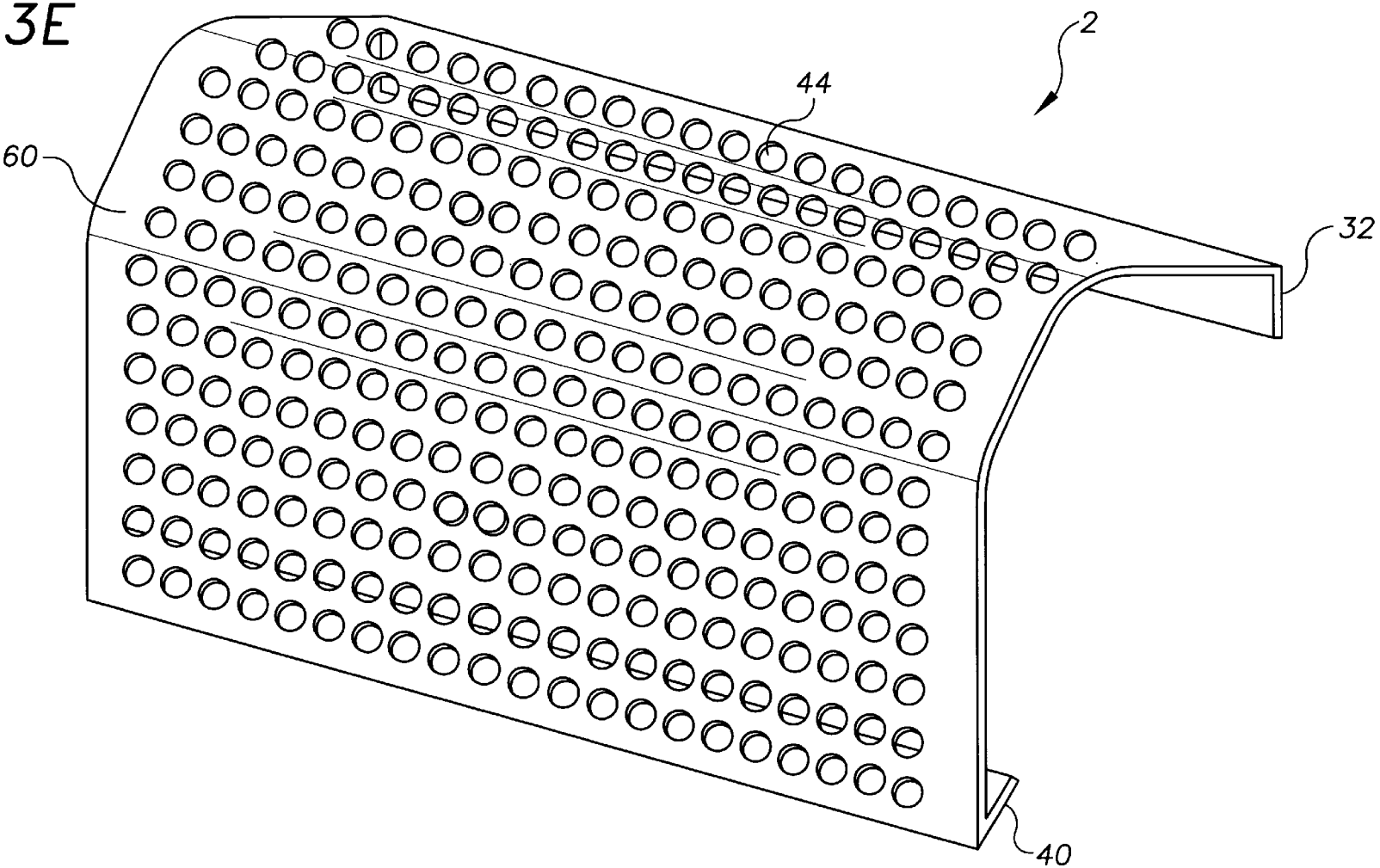
FIG. 3E is an isometric view of a fifth embodiment of the radiator cover.
Figure 4:
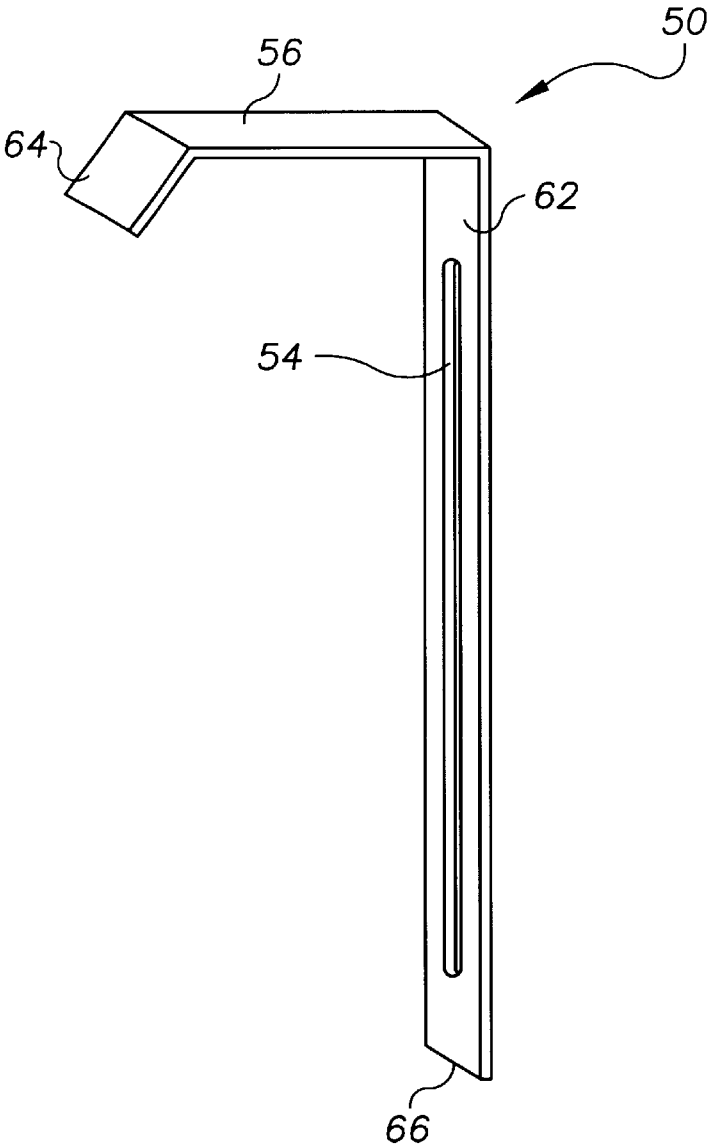
FIG. 4 is an isometric view of the mounting clamp.
Figure 5:
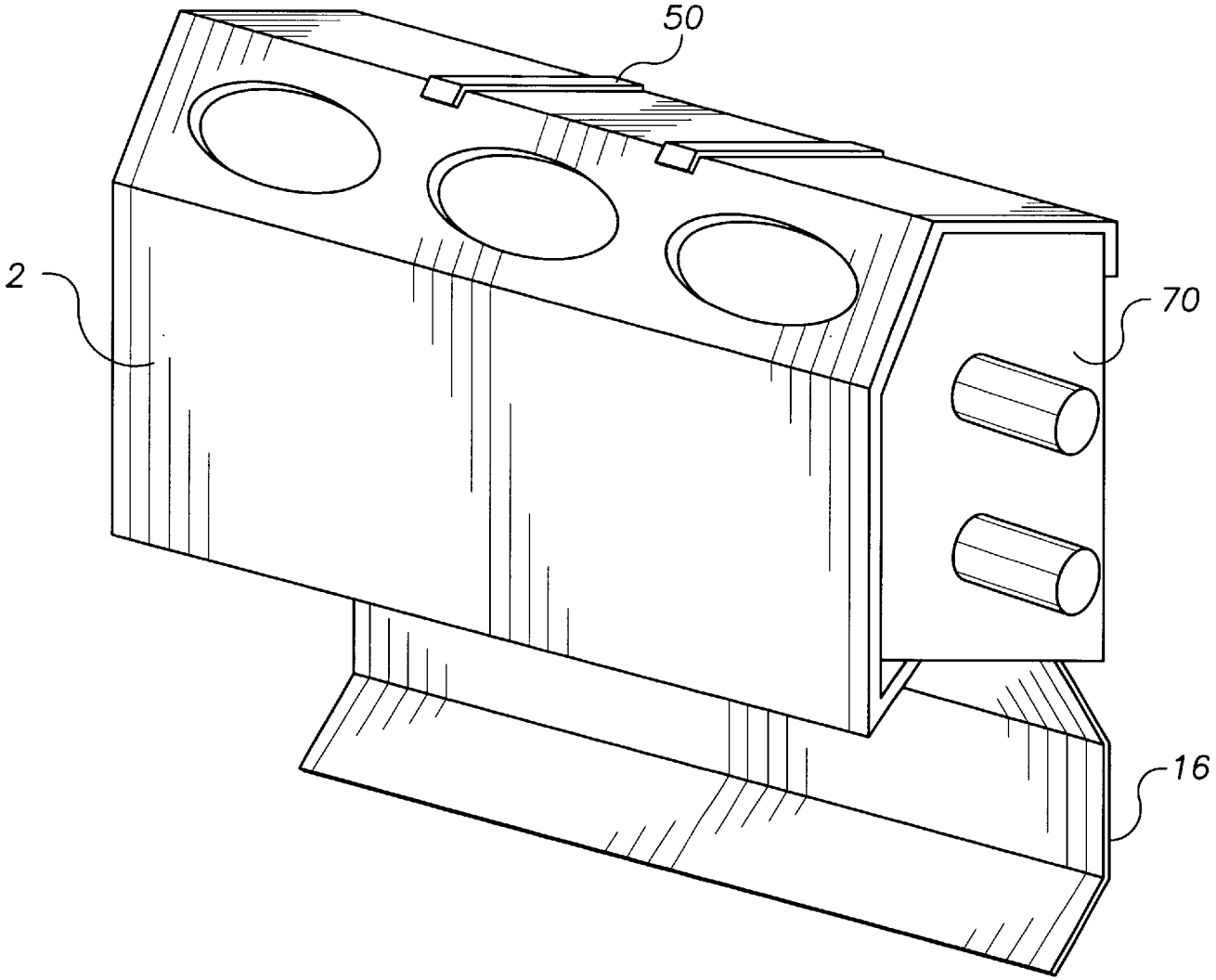
FIG. 5 is an isometric view of an installed radiator and cover.

The cover shown in FIG. 3E has a curved upper front surface 60, eliminating corners on the exposed areas.

The mounting clamp 50 has a top section 56, a front section 64, and a rear section 62. The rear section 62, has a lower edge 66 and a slot 54 through which one or more screws 52 may be fastened. When in a lowered position, the top 56 and front sections 64 secure the radiator in place.

If desired, an end cap 70 may be placed on the end of the radiator.

What I claim is:

1. A radiator having fins, said fins having a lower edge, wherein said lower edge is provided with a rear notch for engaging a mounting system.

2. The radiator of claim 1 wherein said lower edge is further provided with a front notch for engaging a cover.

* * * * *